252-103 AU 166 EX

3/31/81 OR 4,259,201

United States Patent [19]

Cockrell, Jr. et al.

[11] 4,259,201

[45] Mar. 31, 1981

[54] DETERGENT COMPOSITION CONTAINING ORGANIC PERACIDS BUFFERED FOR OPTIMUM PERFORMANCE

[75] Inventors: John R. Cockrell, Jr., Loveland; Dean C. Hanley, Cincinnati, both of Ohio

[73] Assignee: The Procter & Gamble Company, Cincinnati, Ohio

[21] Appl. No.: 93,092

[22] Filed: Nov. 9, 1979

[51] Int. Cl.[3] ..... C11D 7/54

[52] U.S. Cl. ..... 252/103; 252/95; 252/99; 252/186; 8/111

[58] Field of Search ..... 252/99, 95, 103, 186; 8/111

[56] References Cited

U.S. PATENT DOCUMENTS

| | | | |
|---|---|---|---|
| 3,956,159 | 5/1976 | Jones | 252/103 X |
| 4,001,131 | 1/1977 | Montgomery | 252/99 |
| 4,100,095 | 7/1978 | Hutchins et al. | 252/99 |

*Primary Examiner*—Mayer Weinblatt

*Attorney, Agent, or Firm*—Robert B. Aylor; Thomas H. O'Flaherty; Richard C. Witte

[57] ABSTRACT

Granular detergent compositions containing organic peroxyacids are buffered to a pH of from about 8.5 to about 8.6 in water of about 2 grains hardness and no less than about 8 in water of about 14 grains hardness, preferably by using boric acid, to provide optimum overall cleaning.

7 Claims, No Drawings

DETERGENT COMPOSITION CONTAINING ORGANIC PERACIDS BUFFERED FOR OPTIMUM PERFORMANCE

BACKGROUND OF THE INVENTION

This invention relates to granular detergent compositions containing organic peroxyacids to provide effective, low temperature bleaching action. It is known that such organic peroxyacids are most effective at relatively low pHs. It is also known that detergent compositions are more effective at high pHs.

Peroxyacid bleaches have typically been formulated to have a pH in the wash solution of from about 5 to about 10. Lower pH's within this range are incompatible with effective detergency.

SUMMARY OF THE INVENTION

The composition of this invention comprises: (a) from about 0.1% to about 20% of a wash-water-soluble or wash-water-dispersible organic peroxyacid bleaching agent; (b) from about 1% to about 70% of a water-soluble detergent surfactant selected from the group consisting of anionic, nonionic, zwitterionic, amphoteric, semi-polar nonionic, and cationic surfactants and mixtures thereof, (c) from about 3% to about 80% of a detergency builder; and the balance being water, fillers and minor detergent ingredients, the product being buffered to a pH, in a 1500 ppm solution, of from about 8.5 to about 8.6, in water of about 2 grains hardness, and no less than about 8 at 14 grains hardness.

DETAILED DESCRIPTION OF THE INVENTION

Peroxyacid Compound

The bleaching agent of the instant compositions is a normally solid water-soluble and/or water dispersible peroxy acid compound. A compound is normally solid if it is in dry or solid form at room temperature. Such peroxy acid compounds are the organic peroxyacids and water soluble salts thereof which in aqueous solution yield a species containing a —O—O— moiety. The conventional peroxyacid compounds have the general formula $$HO-O-\overset{\overset{\displaystyle O}{\|}}{C}-R-Y$$

wherein R is an alkyl or alkylene group containing from 1 to about 20 carbon atoms preferably from about 6 to about 16 carbon atoms or a phenylene group and Y is selected from the group consisting of hydrogen, halogen, alkyl, aryl, and anionic groups and mixtures thereof. Suitable Y groups include $$-\overset{\overset{\displaystyle O}{\|}}{C}-OM,\ -\overset{\overset{\displaystyle O}{\|}}{C}-O-OM,\ \text{and}\ -\underset{\underset{\displaystyle O}{\|}}{\overset{\overset{\displaystyle O}{\|}}{S}}-OM$$

wherein M is either hydrogen or a cation which preferably provides a wash-water-soluble and/or water dispersible wash-compound.

The organic peroxyacids and salts thereof can contain from 1 to about 4, preferably either 1 or 2 peroxy groups and can be either aliphatic or aromatic. When the organic peroxyacid is aliphatic, the unsubstituted acid has the general formula $$HO-O-\overset{\overset{\displaystyle O}{\|}}{C}-$$

$(CH_2)_n$—Y where Y is selected from the group consisting of $$CH_3,\ CH_2Cl,\ -\overset{\overset{\displaystyle O}{\|}}{C}-OM,\ -\underset{\underset{\displaystyle O}{\|}}{\overset{\overset{\displaystyle O}{\|}}{S}}-OM,\ \text{and}\ -\overset{\overset{\displaystyle O}{\|}}{C}-O-OM,$$

and mixtures thereof wherein n can be an integer from 1 to about 20. Diperazelaic acid (n=7) and diperdodecanedioic acid (n=10) are the preferred compounds of this type. The alkylene linkage and/or Y, where Y is an alkyl group can contain halogen or other noninterfering substitutents.

When the organic peroxyacid is aromatic, the unsubstituted acid has the general formula $$H-O-O-\overset{\overset{\displaystyle O}{\|}}{C}-C_6H_4-Y$$

wherein Y has the meaning given hereinbefore. The peroxy and Y groupings can be in any relative position around the aromatic ring. The ring and/or Y group if alkyl can contain any noninterfering substituent such as halogen groups. Examples of suitable aromatic peroxyacids and salts thereof include monoperoxyphthalic acid, diperoxyterephthalic acid, 4-chlorodiperoxyphthalic acid, the monosodium salt of diperoxyterephthalic acid, m-chloroperoxybenzoic acid, p-nitroperoxybenzoic acid, and diperoxyisophthalic acid.

Of all of the above described organic peroxyacid compounds the most preferred for use in the instant composition are diperoxydodecanedioic acid, diperoxyazelaic, and diperoxyadipic and the $C_{13}$, $C_{14}$ and $C_{15}$ analogs thereof. Peroxy fatty acids ($C_8$-$C_{30}$; preferably $C_{12}$-$C_{18}$) are also desirable.

The amount of the peroxyacid compound used in the present compositions is an amount sufficient to impart effective bleaching properties to the composition. This ranges from about 0.1% to about 20%.

Depending on the desired end result the product should be formulated to deliver from about 0.2 to about 20 ppm available oxygen (Av.O) in the wash solution. For a low level of bleaching which is completely safe for colored fabrics and is seen by the consumer as just a detergent, one should preferably have from about 0.5 to about 3, preferably from about 1 to about 3 ppm Av.O. For a product which is seen as a detergent bleach, but with reasonable color safety one should preferably have from about 3 to about 8 ppm Av.O. For a product which is designed as a detergent (heavy-duty-bleach) one should have from about 8 to about 20 ppm Av.O.

The Detergent Surfactant

Any of the known detergent surfactants can be used in the compositions of this invention. Preferably, the detergent surfactant will not contain any oxidizable group.

The preferred surfactants include the water-soluble salts of higher fatty acids containing from about 8 to about 24 carbon atoms, preferably from about 10 to about 20 carbon atoms such as those derived from coconut oil and tallow.

Other preferred surfactants included the water-soluble salts particularly the alkali metal, ammonium and alkanol ammonium salts of organic sulfuric reaction products having in their molecular structure an alkyl group of from about 8 to about 22 carbon atoms and a sulfonic acid or sulfuric acid ester group. Examples of this group of synthetic surfactants include the sodium and potassium alkyl sulfates wherein the alkyl group contains from about 8 to about 18 carbon atoms, and sodium and potassium alkyl benzene sulfonates in which the alkyl group contains from about 9 to about 15 carbon atoms, preferably in a straight chain configuration. Other desirable examples of this class include alkyl polyethoxylate sulfates wherein the alkyl group contains from about 8 to about 18 carbon atoms and up to 10 ethoxy groups per molecule. Some other specific examples include alpha-sulfonated fatty acids containing from about 6 to about 20 carbon atoms and olefin and paraffin sulfonates wherein the olefin and paraffin groups contain from about 8 to about 20 carbon atoms.

Other preferred surfactants are nonionic surfactants, especially the water-soluble ethoxylates of $C_8$ to $C_{20}$ aliphatic alcohols or $C_6$ to $C_{12}$ alkyl phenols with from about 4 to about 15 moles of ethylene oxide per mole of alcohol or phenol.

Other specific preferred surfactants include water-soluble amine oxides having one alkyl moiety of from about 8 to about 20 carbon atoms and two moieties which are either alkyl or hydroxy alkyl groups containing from 1 to about 3 carbon atoms which can be joined in ring structures either by carbon, carbon bond, or through an ether linkage.

Cationic surfactants include ditallow alkyl dimethyl ammonium chloride, an alkyl trimethyl ammonium chloride wherein the alkyl group contains from about 10 to about 24 carbon atoms, and the corresponding sulfates, methyl sulfates, acetates, etc.

Exhaustive disclosures of suitable surfactants can be found in U.S. Pat. No. 4,056,481, Tate (Nov. 1, 1977); U.S. Pat. No. 4,049,586, Collier (Sept. 29, 1977); U.S. Pat. No. 4,035,257, Cherney (July 12, 1977); U.S. Pat. No. 4,040,988, Vincent et al (Aug. 9, 1977); U.S. Pat. No. 4,033,718, Holcomb et al (July 5, 1977); U.S. Pat. No. 4,019,999, Ohren et al (Apr. 26, 1977); U.S. Pat. No. 4,019,998, Benson et al (Apr. 26, 1977); U.S. Pat. No. 4,000,094, Fleming et al (Dec. 28, 1976); U.S. Pat. No. 4,000,080, Bartolotia et al (Dec. 28, 1976); U.S. Pat. No. 3,992,314, Cherney (Nov. 16, 1976); U.S. Pat. No. 3,985,669, Krummel et al (Oct. 12, 1976); U.S. Pat. No. 3,983,078, Collins et al (Sept. 28, 1976); U.S. Pat. No. 3,954,632, Gloss (May 4, 1976); and U.S. patent application Ser. No. 919,340 filed June 26, 1978 by Cushman M. Cambre, said patents and said patent application being incorporated herein by reference.

The detergent surfactants are present in the composition in amounts from about 1% to about 70%, preferably from about 5% to about 40%, most preferably from about 10% to about 20%.

The Detergent Builder

The compositions also contain a detergency builder in amounts from about 5 to about 80%, preferably from about 20% to about 60%, most preferably from about 30% to about 50%.

Useful builders herein include any of the conventional inorganic and organic water-soluble builder salts as well as various water-insoluble builders.

Inorganic detergency builders useful herein include for example, water-soluble salts of phosphate, pyrophosphates, orthophosphates, polyphosphates, silicates, carbonates, and the like. Organic builders include various water-soluble phosphonates, polyphosphonates, polyhydroxyfulfonates, polyacetates, carboxylates, polycarboxylates, succinates, and the like.

Specific examples of inorganic phosphate builders include sodium and potassium tripolyphosphates, phosphates, and hexametaphosphates. The organic polyphosphonates specifically include, for example, the sodium and potassium salts of ethane 1-hydroxy-1, 1-diphosphonic acid and the sodium and potassium salts of ethane-1,1,2-triphosphonic acid. Examples of these and other phosphorus builder compounds are disclosed in U.S. Pat. Nos. 3,159,581; 3,213,030, 3,422,021; 3,422,137; 3,400,176 and 3,400,148, incorporated herein by reference and in the previously incorporated patents. Sodium tripolyphosphate is an especially preferred, water-soluble inorganic builder herein.

Non-phosphorus containing sequestrants can also be selected for use herein as detergency builders.

Specific examples of non-phosphorus, inorganic builder ingredients include water-soluble inorganic carbonate, bicarbonate, and silicate salts. The alkali metal, e.g., sodium and potassium, carbonates, bicarbonates, and silicates are particularly useful herein.

Water-soluble, organic builders are also useful herein. For example, the alkali metal, ammonium and substituted ammonium polyacetates, carboxylates, polycarboxylates and polyhydroxysulfonates are useful builders in the present compositions and processes. Specific examples of the polyacetate and polycarboxylate builder salts include sodium, potassium, lithium, ammonium and substituted ammonium salts of ethylenediaminetetraacetic acid, nitrilotriacetic acid, oxydisuccinic acid, mellitic acid, benzene polycarboxylic (i.e., penta- and tetra-) acids, and citric acid.

Highly preferred non-phosphorus builder materials (both organic and inorganic) herein sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Other highly preferred organic builders herein are the polycarboxylate builders set forth in U.S. Pat. No. 3,308,067, Diehl, incorporated herein by reference. Examples of such materials include the water-soluble salts of homo- and co-polymers of aliphatic carboxylic acids such as maleic acid, itanconic acid, mesaconic, acid fumaric acid, aconitic acid, citraconic acid and methylenemalonic acid.

Additional, preferred builders herein include the water-soluble salts, especially the sodium and potassium salts, of carboxymethyloxymalonate, carboxymethyloxysuccinate, cis-cyclohexanehexacarboxylate, cis-cyclopentanetetracarboxylate and phloroglucinol trisulfonate.

Another type of detergency builder material useful in the present compositions and processes comprises a water-soluble material capable of forming a water-insoluble reaction product with water hardness cations, preferably in combination with a crystallization seed which is capable of providing growth sites for said reaction product.

Specific examples of materials capable of forming the water-insoluble reaction product include the water-soluble salts of carbonates, bicarbonates, sesquicarbonates, silicates, aluminates and oxalates. The alkali metal, especially sodium salts of the foregoing materials are preferred for convenience and economy.

The crystallization seed employed in such seeded builders is preferably selected from the group consisting of calcium carbonate; calcium and magnesium oxalates; barium sulfate; calcium, magnesium and aluminum silicates; calcium and magnesium oxides; calcium and magnesium salts of fatty acids having 12 to 22 carbon atoms; calcium and magnesium hydroxides; calcium fluoride; and barium carbonate. Specific examples of such seeded builder mixtures comprise 3:1 wt. mixtures of sodium carbonate and calcium carbonate having a 0.5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

A seeded builder comprising a mixture of sodium carbonate and calcium carbonate is especially preferred herein. A highly preferred seeded builder comprises a 30:1 to 5:1 (wt. $Na_2CO_3$:$CaCO_3$) mixture of sodium carbonate and calcium carbonate wherein the calcium carbonate has an average particle diameter from 0.01 micron to 5 microns.

Another type of builder useful herein includes various substantially water-insoluble materials which are capable of reducing the hardness content of laundering liquors, e.g., by ion-exchange processes. Examples of such builder materials include the phosphorylated cloths disclosed in U.S. Pat. No. 3,424,545, to R. A. Bauman, issued Jan. 28, 1969, incorporated herein by reference.

The complex aluminosilicates, i.e., zeolite-type materials, are another type of substantially water-insoluble builder useful in the present compositions, and these materials readily soften water, i.e., remove $Ca^{++}$ hardness. Both the naturally occurring and synthetic "zeolites," especially the zeolite A and hydrated zeolite A materials are useful for this builder/softener purpose. A description of zeolite A materials and a method of preparation appears in U.S. Pat. No. 2,882,243, entitled MOLECULAR SIEVE ADSORBENTS, issued Apr. 14, 1959, incorporated herein by reference.

Additional disclosures of builders can be found in the patents incorporated herein be reference.

The Buffering Agent

The buffering system is selected to provide a pH within the range from about 8 to about 8.6 in the wash solution. Since in the United States the range of water hardnesses is such that most households have a hardness within the range from about 2 grains/gallon to about 14 grains/gallon and since the pH of the water is lower with higher hardnesses, it is preferable to formulate a detergent composition for use in the country at large to have a pH of about 8.5 to about 8.6 in water of 2 grains hardness and a pH of not less than about 8 in water of 14 grains hardness when used at a conventional detergent concentration of about 1,500 ppm. Preferably the pH is as close to 8.6 as possible to improve detergency.

A suitable buffering agent is boric acid. Boric acid can typically be present in amounts from about 2% to about 10%.

Miscellaneous Other Ingredients

The compositions herein can contain all manner of detergent adjunct materials and carriers commonly found in laundry and cleaning compositions. For example, various perfumes, optical brighteners, fillers, anticaking agents, fabric softeners and the like can be present to provide the usual benefits occasioned by the use of such materials and detergent compositions. Enzymes can also be included in the composition. Preferably the peroxyacid is added in a stabilized form according to the teachings of U.S. Pat. No. 4,100,095, Hutchins et al (July 1978), incorporated herein by reference. Preferably the compositions herein are essentially free of diketone peroxygen bleach activating agents as taught in U.S. Pat. No. 4,001,131, Montgomery (Jan. 4, 1977), incorporated herein by reference.

The solid peroxygen bleaching/detergent compositions herein are prepared by simply admixing the bleach ingredients with a conventional spray-dried detergent composition. When preparing mixed detergent/bleaches, the peroxyacid and optional stabilizer can be mixed either directly with the detergent compound, builder, etc., or the peroxyacid and optional stabilizer can be separately or collectively coated with a nonreactive wash-water-soluble or wash-water-dispersible coating material to prevent premature activation of the bleaching agent. The coating process is conducted according to known procedures in the art utilizing known coating materials. Suitable coating materials include compounds such as mineral oil, magnesium sulfate hydrate, or the like.

All percentages, ratios and parts herein are by weight unless otherwise specified.

EXAMPLE

The following data was obtained utilizing a base detergent formula containing about 7% sodium $C_{12}$ linear alkyl benzene sulfonate, and about 5.5% sodium tallow alkyl sulfate; about 5.5% sodium $C_{14-15}$ alkyl polyethoxylate (2.25) sulfate; about 2 to 4% sodium tripolyphosphate; about 1.5% sodium silicate (2.0 r); about 16.9% sodium sulfate; about 10% sodium carbonate; about 17.6% hydrated sodium type A zeolite (approximately 3 micron diameter); and the balance miscellaneous and water. To this base formula was added about 8.62% of prills containing about 13.9% diperoxy dodecanedioic acid; about 15.3% boric acid; about 66.8% $Na_2SO_4$; about 3% sodium $C_{13}$ linear alkyl benzene sulfonate, and the balance miscellaneous including sodium pyrophosphate, phosphoric acid, and dipicoline acid stabilizers and dodecanedioic acid.

The testing was done in Terg-o-tometers and miniwashers using swatches of polyester, polyester/cotton cotton stained with clay and cotton stained with respectively grape juice and tea. The detergent solution containing 1500 ppm of the detergent composition and 2 ppm Av.O from the diperoxydodecanedioic acid prills. Sulfuric acid was added as required to adjust the pH. At a median hardness of 8 grains per gallon the detergency performance on clay as compared to the base formula was as follows.

| Fabric | Clay Removal pHs | | | |
|---|---|---|---|---|
| | 7.5 | 8 | 8.5 | 9 |
| Polycotton | −2.5 | +1.2 | +1.2 | 0 |
| Cotton | −10 | −4.6 | −3.8 | −3.6 |
| Polyester | −6.6 | −3.2 | −4 | −4.2 |

(Δ Hunter whiteness units versus base as a control)

As can be seen from the above data, within this range and at this hardness, clay removal drops off as the pH is dropped from 8 to 7.5 but does not improve from 8.5 to 9.

Substantially similar results are obtained when any of the specifically named surfactants, detergency builders, peroxyacids, etc. are substituted for the specific ingredients contained in this Example.

Based on extensive experience the performance at 7.5 will be seen as unacceptable when compared to the base formula by a substantial percentage of users, whereas the performance at 8 and 8.5 will not be seen as unacceptable by any substantial percentage of users.

| Stain on Cotton | Bleach Performance pHs | | | |
|---|---|---|---|---|
| | 7.5 | 8 | 8.5 | 9 |
| Grape Juice | +1.6 | +1.5 | +1.3 | +.7 |
| Tea | 1.7 | 1.2 | 1.25 | 0.7 |

(Difference in Index of Fabric Discoloration versus base as a control --about one unit is consumer noticeable.)

As can be seen from the above, the bleaching effectiveness drops as the pH is raised from 8.5 to 9 to a point where the bleaching benefit is no longer noticed by a substantial number of consumers. Raising the pH from 7.5 to the range from 8 to 8.5 does not change acceptability in that a substantial number of consumers will see the benefit from the bleaches presence.

EXAMPLE II

| Components | % by Weight |
|---|---|
| Sodium $C_{14-15}$ alkyl polyethoxylate (2.2) sulfate | 5.5 |
| Sodium tallow alkyl sulfate | 5.5 |
| Sodium $C_{12}$ linear alkylbenzene sulfonate | 3.5 |
| Hydrated sodium type A Zeolite (approximately 3 micron diameter) | 24.4 |
| Sodium silicate (2.0r) | 1.5 |
| Sodium sulfate | 16.9 |
| The prill of Example I (2.5 ppm Av.0) | 9.5 |
| Boric acid | 4.0 |
| Moisture and miscellaneous | Balance |

The above composition is a desirable heavy-duty laundry detergent having effective bleaching action that is completely safe to colored clothes an effective particulate detergency.

What is claimed is:

1. A granular detergent composition consisting essentially of:

(a) from about 0.1% to about 20% of a wash water-soluble or wash-water-dispersible organic peroxy acid bleaching agent having the formula $$HO-O-\overset{\overset{\displaystyle O}{\|}}{C}-R-Y$$

wherein R is an alkyl or alkylene group containing from 1 to about 20 carbon atoms preferably from about 6 to about 16 carbon atoms or a phenylene group and Y is selected from the group consisting of hydrogen, halogen, alkyl, aryl, and anionic groups and mixtures thereof;

(b) from about 1% to about 70% of a water-soluble detergent surfactant selected from the group consisting of anionic, nonionic, zwitterionic, amphoteric, semi-polar nonionic and cationic surfactants, and mixtures thereof;

(c) from about 5% to about 80% of a detergency builder; the balance being water sodium sulfate, or mixtures thereof, the product being buffered to a pH, in a 1500 ppm solution, of from about 8.5 to about 8.6 in water of about 2 grains hardness; and to no less than about 8 in water of 14 grains hardness.

2. The composition of claim 1 wherein the buffering agent is boric acid.

3. The composition of claim 2 wherein the boric acid is present at a level of from about 2% to about 10% by weight of the composition.

4. The composition of claim 1 wherein the surfactant level is from about 5% to about 40%, the detergency builder level is from about 20% to about 60%, and the peroxy acid compound is present in an amount to give from about 0.5 to about 3 ppm available oxygen in the wash solution.

5. The composition of claim 4 wherein the detergent surfactant level is from about 10% to about 20%, the detergency builder level is from about 30% to about 50%, and the buffer is boric acid.

6. The composition of claim 1 wherein the bleach is present to give a level of from about 3 to about 8 ppm available oxygen in the wash solution.

7. The composition of claim 1 wherein the bleach is present at a level to give from about 8 to about 20 ppm available oxygen in the wash solution.

* * * * *